US010913651B2

(12) United States Patent
Eggler et al.

(10) Patent No.: US 10,913,651 B2
(45) Date of Patent: Feb. 9, 2021

(54) CONTAINER EMPTYING DEVICE AND METHODS FOR OPERATING AND CLEANING A CONTAINER EMPTYING DEVICE

(71) Applicant: Tetra Laval Holdings & Finance S.A., Pully (CH)

(72) Inventors: Thomas Eggler, Rothrist (CH); Franco Acklin, Leutwil (CH); Denis Steffen, Oftringen (CH)

(73) Assignee: Tetra Laval Holdings & Finance S.A., Pully (CH)

( * ) Notice: Subject to any disclaimer, the term of this patent is extended or adjusted under 35 U.S.C. 154(b) by 183 days.

(21) Appl. No.: 15/747,450

(22) PCT Filed: Sep. 19, 2016

(86) PCT No.: PCT/EP2016/072128
§ 371 (c)(1),
(2) Date: Jan. 25, 2018

(87) PCT Pub. No.: WO2017/050680
PCT Pub. Date: Mar. 30, 2017

(65) Prior Publication Data

US 2018/0208453 A1 Jul. 26, 2018

(30) Foreign Application Priority Data

Sep. 24, 2015 (SE) ..... 1551228

(51) Int. Cl.
*B67D 7/64* (2010.01)
*B67D 7/40* (2010.01)
(Continued)

(52) U.S. Cl.
CPC ..... *B67D 7/645* (2013.01); *B67D 7/40* (2013.01); *B67D 7/68* (2013.01); *B67D 7/70* (2013.01); *B67D 7/74* (2013.01)

(58) Field of Classification Search
CPC . B67D 7/645; B67D 7/74; B67D 7/68; B67D 7/40; B65B 3/04
See application file for complete search history.

(56) References Cited

U.S. PATENT DOCUMENTS 3,601,285 A * 8/1971 Leger ..... B67D 7/62 222/250
4,905,871 A * 3/1990 Dutertre ..... B08B 9/093 134/168 R (Continued)

FOREIGN PATENT DOCUMENTS

DE 4424531 1/1996
EP 2314542 4/2011

OTHER PUBLICATIONS

International Search Report from corresponding PCT Application No. PCT/EP2016/072128 dated Mar. 3, 2017 (4 pages).

(Continued)

*Primary Examiner* — Mikhail Kornakov
*Assistant Examiner* — Natasha N Campbell
(74) *Attorney, Agent, or Firm* — Finnegan, Henderson, Farabow, Garrett & Dunner LLP

(57) ABSTRACT

The invention relates to a container emptying device (1) for emptying at least one container (6) filled with a liquid, comprising a suction unit (2), a receiving unit (4) and a pipe unit (3) connecting the receiving unit (4) with the suction unit (2). The suction unit (2) comprises at least one suction lance (2*a*) adapted to be inserted and lowered into the container (6), at least one pump (2*c*), connecting the suction lance (2*a*) with the pipe unit (3), for pumping the liquid out of the container (6) and a control device for controlling a (Continued)

suction process. The pipe unit (3) comprises at least one flexible pipe for transporting the liquid out of the container (6).

15 Claims, 1 Drawing Sheet

(51) Int. Cl.

| | |
|---|---|
| ***B67D 7/68*** | (2010.01) |
| ***B67D 7/70*** | (2010.01) |
| ***B67D 7/74*** | (2010.01) |

(56) References Cited

U.S. PATENT DOCUMENTS

| | | | |
|---|---|---|---|
| 2006/0207510 | A1 | 9/2006 | Croft |
| 2010/0129252 | A1 | 5/2010 | Takase |
| 2011/0253743 | A1 | 10/2011 | Foster |

OTHER PUBLICATIONS

Office Action from corresponding Swedish Application No. 1551228-8 dated May 4, 2016 (7 pages).

* cited by examiner

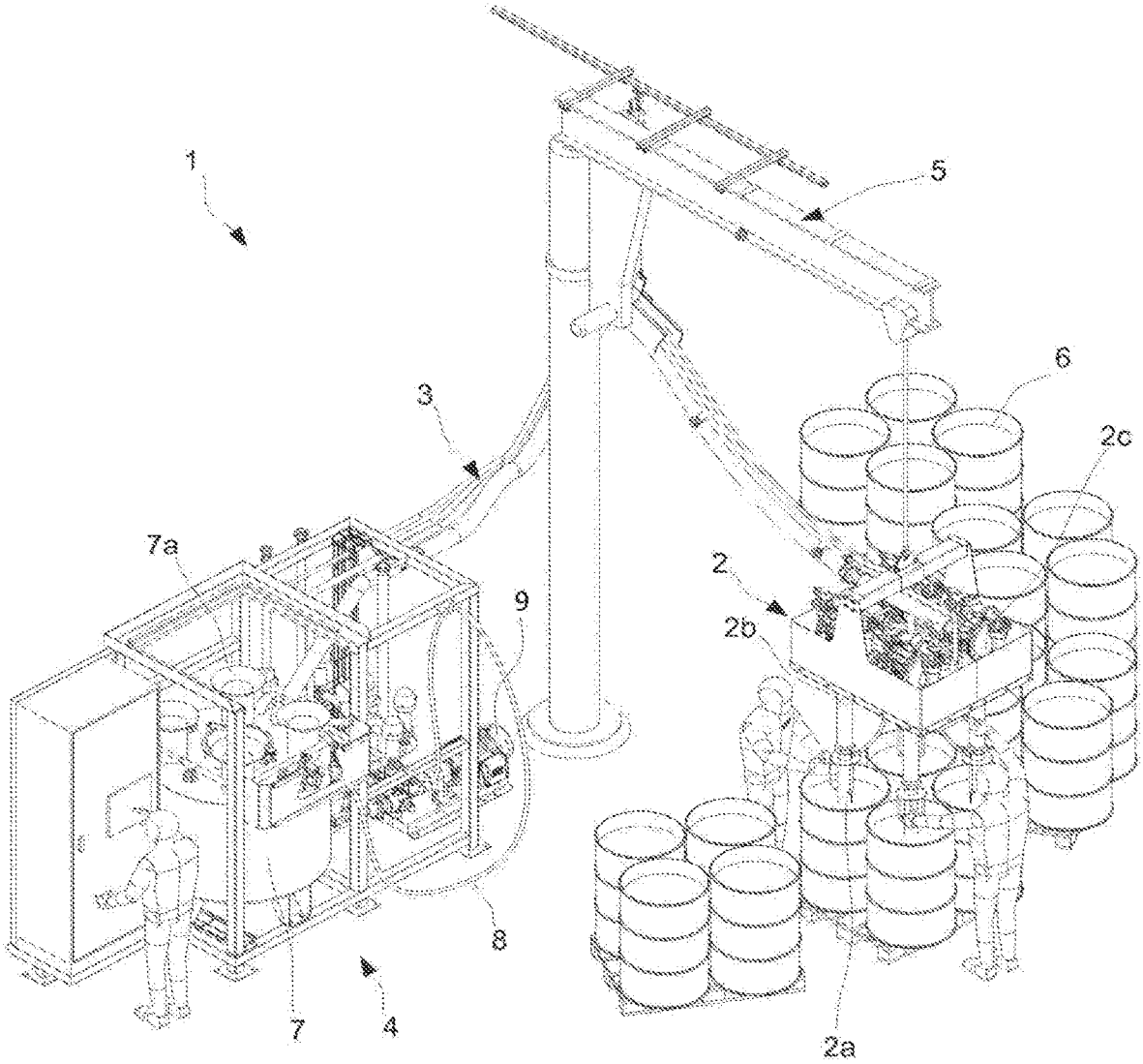
1
5
6
3
2c
7a
2
9
2b
8
7
4
2a

CONTAINER EMPTYING DEVICE AND METHODS FOR OPERATING AND CLEANING A CONTAINER EMPTYING DEVICE

CROSS-REFERENCE TO RELATED PATENT APPLICATIONS

This is a National Phase of International Application No. PCT/EP2016/072128, filed Sep. 19, 2016, which claims the benefit of Swedish Application No. 1551228-8, filed Sep. 24, 2015. The entire contents of the above-referenced applications are expressly incorporated herein by reference.

TECHNICAL FIELD

The invention relates to a container emptying device, a method for operating and a method for cleaning a container emptying device according to the independent claims.

BACKGROUND

Containers, such as container drums, are normally emptied by tilting the container by means of devices adapted to lift, support and pivot the container above a further processing receptacle in order to empty its contents into the receptacle. A disadvantage of such devices is that debris may also fall into the receptacle, e.g. contaminations accumulated on the outside of the container, particularly on its top side, like rust or dust, and accumulations inside the container.

DESCRIPTION OF THE INVENTION

It is an objective of the present invention to at least minimize said disadvantages.

This objective is reached by the independent claims.

In a first aspect of the invention a container emptying device for emptying at least one container filled with a liquid, such as a container drum, is provided. The container emptying device comprises a suction unit, a receiving unit and a pipe unit connecting the receiving unit with the suction unit. The suction unit comprises at least one suction lance adapted to be inserted and lowered into the container, at least one pump, connecting the suction lance with the pipe unit, for pumping the liquid out of the container, and a control device for controlling a suction process. The pipe unit comprises at least one flexible pipe for transporting the liquid out of the container.

In a second aspect of the invention a method for operating the container emptying device according to the first aspect of the invention is provided. The method comprises the steps of:

a) positioning the suction unit above the container or containers to be emptied, b) positioning the at least one suction lance above a corresponding opening of the container attributed to the respective suction lance, c) lowering the suction unit such that the at least one suction lance enters the container to be emptied until a predefined depth, d) initiating the suction process of liquid from the container or containers by switching on the pump or pumps, (e) raising the suction unit such that the suction lance or lances are removed from the container or containers, respectively, after the emptying process has been completed.

In embodiments, a dissolving liquid is added to the liquid extracted from the container or containers as an additional step, particularly during the suction process. Preferably, the mixing ratio between the dissolving liquid and the liquid extracted from the container is controlled by the control device.

In a third aspect of the invention a method for cleaning the container emptying device according to the first aspect of the invention, after having emptied the container, is provided. The receiving unit comprises a buffer tank for receiving the liquid sucked out of the container by the suction unit or the receiving unit comprises a cleaning tank. The cleaning method comprises the steps of either:

i) ensuring the liquid previously extracted from the container and transported into the buffer tank has already been removed from the latter, ii) moving the suction unit above the buffer tank and lowering the suction lance or suction lances into the buffer tank, iii) pumping a cleaning agent into the buffer tank via an inlet for the cleaning agent, iv) recirculating the cleaning agent through a cleaning circuit consisting of the buffer tank, the at least one suction lance lowered into the buffer tank and the pipe unit for a predefined duration, v) disposing of the used cleaning agent via an outlet for the used cleaning agent or:

i) moving the suction unit above the cleaning tank and lowering the suction lance or suction lances into the cleaning tank, ii) pumping a cleaning agent into the cleaning tank via an inlet for the cleaning agent, iii) recirculating the cleaning agent through a cleaning circuit consisting of the cleaning tank, the at least one suction lance lowered into the cleaning tank and the pipe unit for a predefined duration, iv) disposing of the used cleaning agent via an outlet for the used cleaning agent.

In embodiments, after cleaning the container emptying device an additional step of rinsing the cleaning circuit with a rinsing agent, particularly water, is carried out.

The container emptying device according to the first aspect of the invention is preferably used for simultaneously emptying a plurality of containers, particularly four containers.

The container emptying device is preferably targeted to applications in case of which the containers to be emptied shall not be tilted before and during the emptying process.

SHORT DESCRIPTION OF THE DRAWING

Embodiments, advantages and applications of the invention result from the dependent claims and from the now following description by means of the FIGURE. The FIGURE shows a perspective view of a container emptying device according to the invention during the process of simultaneously emptying four containers.

WAYS OF CARRYING OUT THE INVENTION

The FIGURE shows a container emptying device 1 according to the invention during the process of simultaneously emptying four containers 6. As mentioned, the container emptying device comprises a suction unit 2, a receiving unit 4 and a pipe unit 3 connecting the receiving unit 4 with the suction unit 2.

In the exemplary embodiment of the FIGURE the suction unit 2 comprises four suction lances 2*a*. The number of suction lances is exemplary and can be chosen differently. Each of the suction lances 2*a* is attributed to an individual container 6 for simultaneously emptying the four containers 6, subsequently also called container batch. Advantageously, by simultaneously emptying multiple containers 6, the suction process is accelerated.

Preferably, an individual pump 2*c* is provided for each suction lance 2*a*. This allows an independent suction operation for each container 6 of the batch. Such a configuration is advantageous e.g. in case the containers 6 of a batch are not all filled to the same level. In this case the pumps can be switched off independently as soon as the respective container 6 is empty.

Preferably, at least one flexible hose 2*b* connects the at least one suction lance 2*a* with the at least one pump 2*c*. In the present example four flexible hoses 2*b* are provided. This optional feature advantageously allows an easy positioning of the suction lance 2*a* above the opening of the container or drum 6. It is therefore not necessary that the container batch is positioned precisely below the suction lance array. In embodiments, the length of the flexible hoses 2*b* are chosen such that the respective suction lance 2*a* can be lowered to the bottom of the container 6. The flexible hose 2*b* may be rolled onto a drum and pulled from the drum if required.

In embodiments, the pumps 2*c* are diaphragm pumps. Although other types of pumps can be used as well, this type of pump 2*c* is preferred amongst others because it can handle highly viscous liquids and because of its good suction lift characteristics and high discharge pressures.

Preferably, the suction lances 2*a* comprise each a non-return valve (not shown) arranged at a container-side opening of the suction lance 2*a*. The non-return valves prevent liquid already sucked out of the container to flow back into it, e.g. when the suction pressure decreases or the respective pump 2*c* is switched off. It is advantageous to arrange the non-return valves directly at the opening of the suction lance 2*a* so the non-return feature takes effect for the entire liquid present inside the suction lance 2*a*.

The suction unit 2 is movable between the receiving unit 4 and a container emptying location (location of the suction unit in the FIGURE) by means of a crane 5. The crane 5 is further adapted to lower and rise the suction unit 2. In this way it is easy to move the entire suction unit 2 to the required location. Certainly, the crane 5 may be operated automatically, e.g. also by remote control, or manually.

The pipe unit 3 may comprise one pipe for transporting the liquid or it may comprise multiple pipes, each of which is attributed to one container 6 to be emptied.

Preferably, the pipe unit 3 additionally comprises at least one auxiliary pipe for mixing a dissolving liquid, particularly water, with the liquid from the container 6 during a transfer process of the liquid from the containers 6. This is preferred for a highly viscous liquid (e.g. above 10000 cp) in order to reduce the suction effort and therefore to save energy. Furthermore, in applications, this also anticipates a mixing step, e.g. with water, of a subsequent treatment process for the liquid from the containers 6. Therefore, a further processing step may be saved in this way. As mentioned, the pumps 2*c* may be able to deal with very viscous liquids without this mixing step. However, this option accounts for the use of other types of pipes or for cost saving reasons.

It is noted that the pipe unit 3 is designed to be replaceable with another type of pipe unit 3. The new pipe unit may have more or less pipes and/or its pipes may have a different diameter and/or it may comprise or not an auxiliary pipe.

In embodiments, the receiving unit 4 comprises a buffer tank 7, e.g. of 10001 volume, for receiving the liquid sucked out of the container 6 by the suction unit 2 or it comprises a cleaning tank (not shown) for cleaning the pipe unit 3 and the suction unit 2.

The first option (buffer tank) is provided for systems where the liquid sucked out of the containers 6 has to be buffered before it can be transported to a further processing installation. The buffer tank 7 may be integrated with the receiving unit 4 or it may be replaceable with another buffer tank. Preferably, a number of openings 7*a* of the buffer tank 7 for receiving the liquid matches the number of suction lances 2*a*. In the present embodiment, the pipe unit 3 preferably comprises four pipes for simultaneously transporting the liquid, each to an attributed opening of the buffer tank 7.

The second option (cleaning tank) is provided for systems where the liquid is directly pumped into the further processing installation, which may itself have a buffer tank or which may process the liquid directly for every container batch. In this case the cleaning tank, which in this configuration is preferably movable and replaceable, is only used for providing a means for closing a cleaning circuit, which will be described in more detail below in connection with the cleaning-in-place functionality of the container emptying device 1.

The receiving unit 4 further comprises a product pump 9 for transferring the liquid from the buffer tank 7 to a further processing installation (not shown). Preferably, the product pump 9 can be operated independently from the suction unit 2. It may particularly transport the liquid from the buffer tank 7 to the further processing installation simultaneously with the suction process of the suction unit 2. In other embodiments, the product pump 9 may operate batchwise, i.e. start the emptying process after the buffer tank 7 has been filled up. Even though it may be operated independently, it is also possible to synchronize the suction rate of the product pump 9 with the suction rate of the pump or pumps 2*c* and/or monitor said suction rates by using a controller and suitable flow sensors. For example, the suction rate of the product pump may be in the range between 5 and 20 $m^3/h$.

The receiving unit 4 further comprises a cleaning-in-place subunit for cleaning the buffer tank 7 and/or the suction unit 2 and/or the pipe unit 3 and/or the at least one container 6. In embodiments, the cleaning-in-place subunit comprises a movable spray gun 8 for washing out the containers 6 with a cleaning agent.

In embodiments, the cleaning-in-place subunit comprises an inlet for a cleaning agent and an outlet for a used cleaning agent. Typically, a cleaning agent is water. The inlet is arranged and adapted to feed the cleaning agent into a cleaning circuit consisting of the buffer tank 7 or the cleaning tank, the at least one suction lance 2*a* lowered into the buffer tank 7 or the cleaning tank and the pipe unit 3. The outlet is arranged and adapted to receive and dispose of used cleaning agent from said cleaning circuit. Thus, the buffer tank 7, which was previously used for receiving the liquid from the containers 6, is now used to form said cleaning circuit. Alternatively, when no buffer tank 7 is used in the container emptying device 1, said cleaning tank is used to close the cleaning circuit instead of the buffer tank 7. In the following a method for cleaning the container emptying device 1 after a container emptying process is described. The method comprises two options, the steps of which are explained in the following.

In a first option, in a configuration of the container emptying device with buffer tank, firstly it is made sure that the liquid previously extracted from the containers 6 and transported into the buffer tank 7 has already been removed from the latter. If no buffer tank is being used, this step is obsolete and a cleaning tank is used for the cleaning-in-place process. Subsequently, the suction unit 2 is moved above the buffer tank 7 and the suction lances 2*a* are lowered into the buffer tank 7. Thereafter, a cleaning agent is pumped into the buffer tank 7 via an inlet for the cleaning agent. In a next step, the cleaning agent is recirculated through a cleaning circuit consisting of the buffer tank 7, the suction lances 2*a* lowered into the buffer tank 7 and the pipe unit 3 for a predefined duration. Finally, the used cleaning agent is disposed of via an outlet for used cleaning agent. Thus, in this configuration the buffer tank 7 is a dual-purpose tank, for storing the liquid and for enabling the cleaning-in-place process.

In a second option, in a configuration of the container emptying device with cleaning tank, firstly the suction unit 2 is moved above the cleaning tank and the suction lances 2*a* are lowered into the cleaning tank. Subsequently, the suction unit 2 is moved above the cleaning tank and the suction lances 2*a* are lowered into the cleaning tank. Thereafter, a cleaning agent is pumped into the cleaning tank via an inlet for the cleaning agent. In a next step, the cleaning agent is recirculated through a cleaning circuit consisting of the cleaning tank, the suction lances 2*a* lowered into the cleaning tank and the pipe unit 3 for a predefined duration. Finally, the used cleaning agent is disposed of via an outlet for used cleaning agent.

An optional step may consist in rinsing the cleaning circuit with a rinsing agent, particularly water, after having cleaned the container emptying device 1. This is particularly useful if the cleaning agent wasn't water but e.g. a detergent.

In the following, the method for operating the container emptying device 1 will be described in more detail. The method comprises the steps described below.

In a first step a) the suction unit 2 is positioned above the container or containers 6 to be emptied. In a second step b) the suction lances 2*a* are each positioned above a corresponding opening of one of the four containers 6. In a third step c) the suction unit 2 is lowered such that the suction lances 2*a* enter the containers 6 to be emptied until a predefined depth. Alternatively or additionally, as described, the flexible hoses 2*b* between the suction lances 2*a* and the pumps 2*c* may be unrolled from a drum for lowering the suction lances 2*a* into the containers 6. In a fourth step d) the suction process of liquid from the container or containers 6 is initiated by switching on the pump or pumps 2*c*. After the containers 5 have been emptied entirely or up to the desired level, the suction unit 2 is raised in a fifth step e) such that the suction lances 2*a* are removed from the container or containers 6. Alternatively or additionally, the flexible hoses 2*b* are rolled back onto the drum.

An additional optional step may consist in the addition of a dissolving liquid to the liquid extracted from the container or containers 6, particularly during the suction process, as mentioned above. In embodiments, the mixing ratio between the dissolving liquid and the liquid extracted from the container 6 is controlled by the control device.

The proposed solution advantageously makes emptying of containers more efficient by giving the possibility to empty more than one container simultaneously. Furthermore the containers can be kept standing and don't have to be tilted in order to be emptied, such that no contaminations on their outer surface can be mixed with the liquid to be extracted. It is even possible to account for sedimentations or sludge at the bottom of the container. In this case the suction lances are not lowered to the bottom of the container but the lowering is halted at a certain distance therefrom. Subsequently, the pumps are operated, but only with such power that the suction is gentle, thereby minimizing resuspension of said sludge.

In another aspect of the invention the container emptying device 1 may also be used for simultaneously filling a container or a plurality of containers. It is noted that this functionality is possible despite the naming of the device as "emptying" device, which is its main but not necessarily its single purpose. In this use, the pump or pumps 2*c* of the suction unit 2 are operated in an opposite direction with respect to the emptying direction. They extract liquid from a buffer tank 7 of the receiving unit 4 in order to fill it into the container or containers 6. For this operating mode the container emptying device may comprise a level sensor, preferably attached to the opening of one of the suction lances 2*a* and connected to the control unit. As soon as the sensor detects the liquid has reached the opening of the suction lance 2*a*, it sends a signal to the control unit which then stops the filling process by controlling the pumps 2*c* accordingly. This is one example of detecting the filling level in the container. Other known methods may be used as well.

While there are shown and described presently preferred embodiments of the invention, it is to be distinctly understood that the invention is not limited thereto but may otherwise variously be embodied and practised within the scope of the following claims. Therefore, terms like "preferred" or "in particular" or "particularly" or "advantageously", etc. signify optional and exemplary embodiments only.

The invention claimed is:

1. A container emptying device for emptying at least one container, filled with a liquid, comprising:

a suction unit;

a receiving unit;

a pipe unit connecting the receiving unit with the suction unit, wherein the suction unit further comprises:

at least one suction lance configured to be inserted and lowered into the at least one container, at least one pump, connecting the at least one suction lance with the pipe unit, for pumping the liquid out of the at least one container, and a controller for controlling a suction process where the at least one pump uses the suction lance to pump the liquid out of the at least one container, wherein the pipe unit further comprises at least one flexible pipe for transporting the pumped liquid out of the at least one container, wherein the receiving unit comprises:

a buffer tank for receiving the liquid suctioned out of the at least one container by the suction unit;

a cleaning-in-place subunit for cleaning at least one of the buffer tank, the suction unit, the pipe unit, or the at least one container, and wherein the cleaning-in-place subunit comprises:

an inlet for a cleaning agent and an outlet for a used cleaning agent; and a cleaning circuit configured to receive the cleaning agent from the inlet, wherein the cleaning circuit comprises: (a) the buffer tank, (b) the at least one suction lance lowered into the buffer tank, and (c) the pipe unit, wherein the outlet is configured to receive and dispose of used cleaning agent from the cleaning circuit.

2. The container emptying device according to claim 1, wherein the suction unit comprises four suction lances, each of the suction lances configured to be inserted into a corresponding individual container, such that the four suction lances are configured to simultaneously empty the corresponding containers.

3. The container emptying device according to claim 2, wherein the suction unit comprises an individual pump for each suction lance.

4. The container emptying device according to claim 1, wherein the suction unit comprises at least one flexible hose which connects the at least one suction lance with the at least one pump.

5. The container emptying device according to claim 1, wherein the at least one suction lance comprises a non-return valve arranged at a container-side opening of the at least one suction lance and configured to prevent liquid from flowing backward back into the at least one container during the suction process.

6. The container emptying device according to claim 1, further comprising a crane configured to move the suction unit between the receiving unit and a container emptying location, wherein the crane is further configured to lower and raise the suction unit with respect to the at least one container.

7. The container emptying device according to claim 1, wherein the pipe unit further comprises at least one auxiliary pipe for mixing a dissolving liquid with the liquid from the at least one container during the suction process of pumping the liquid from the at least one container.

8. The container emptying device according to claim 1, wherein the receiving unit further comprises a product pump for transferring the liquid from the buffer tank to a further processing installation, wherein the product pump is operated independently from the suction unit.

9. The container emptying device according to claim 1, wherein the cleaning-in-place subunit comprises a movable spray gun for washing the at least one container with the cleaning agent.

10. The container emptying device according to claim 1, wherein the at least one pump of the suction unit is configured to operate in an opposite direction with respect to the emptying direction, such that in the opposite direction, the at least one pump is configured to extract liquid from a buffer tank of the receiving unit and to fill the at least one container with the extracted liquid.

11. A method of using the container emptying device according to claim 10, comprising:

positioning the suction unit above the at least one container to be emptied;

positioning the at least one suction lance above a corresponding opening of the at least one container;

lowering the suction unit such that the at least one suction lance is lowered into the at least one container;

switching on the at least one pump to initiate the suction process of pumping the liquid from the at least one container; and raising, after completing the suction process, the suction unit until the at least one suction lance is removed from the at least one container, wherein a maximum filling level of liquid in the at least one container is detected by a level sensor attached to at least one of the suction lances at an opening of the at least one container.

12. A method for operating the container emptying device according to claim 1, comprising:

positioning the suction unit above the at least one container to be emptied;

positioning the at least one suction lance above a corresponding opening of the at least one container associated with the at least one suction lance;

lowering the suction unit such that the at least one suction lance is lowered into the at least one container to a predefined depth;

switching on the at least one pump to initiate the suction process of pumping the liquid from the at least one container; and raising, after completing the suction process, the suction unit until the at least one suction lance is removed from the at least one container.

13. The method according to claim 12, further comprising:

adding a dissolving liquid to the liquid extracted from the at least one container during the suction process.

14. A method for cleaning the container emptying device according to claim 1 after a container emptying process, wherein the receiving unit comprises a buffer tank for receiving the liquid pumped out of the at least one container by the suction unit, comprising:

ensuring the liquid previously extracted from the at least one container and transported into the buffer tank has been removed from the buffer tank;

moving the suction unit above the buffer tank and lowering the at least one suction lance into the buffer tank;

pumping a cleaning agent into the buffer tank via an inlet for the cleaning agent, recirculating, for a predefined duration, the cleaning agent through a cleaning circuit that comprises the buffer tank, the at least one suction lance lowered into the buffer tank and the pipe unit; and disposing of the used cleaning agent via an outlet for the used cleaning agent.

15. The method for cleaning the container emptying device according to claim 14 after a container emptying process, wherein the receiving unit comprises a cleaning tank, the method comprising:

moving the suction unit above the cleaning tank and lowering the at least one suction lance into the cleaning tank;

pumping a cleaning agent into the cleaning tank via an inlet for the cleaning agent;

recirculating the cleaning agent, for a predefined duration, through a cleaning circuit consisting of the cleaning tank, the at least one suction lance lowered into the cleaning tank, and the pipe unit; and disposing, after the recirculating, of the used cleaning agent via an outlet for the used cleaning agent.

* * * * *